United States Patent [19]

Schiele

[11] Patent Number: 4,686,887

[45] Date of Patent: Aug. 18, 1987

[54] APPARATUS FOR SUPPLYING CARTRIDGE BELTS FROM A MAGAZINE TO A MACHINE GUN

[75] Inventor: August Schiele, Augsburg, Fed. Rep. of Germany

[73] Assignee: Kuka Wehtechnik GmbH, Augsburg, Fed. Rep. of Germany

[21] Appl. No.: 839,540

[22] Filed: Mar. 14, 1986

[30] Foreign Application Priority Data

Mar. 22, 1985 [DE] Fed. Rep. of Germany ..... 3510308

[51] Int. Cl.[4] ..... F41D 10/14

[52] U.S. Cl. ..... 89/33.16; 89/33.5

[58] Field of Search ..... 89/33.01, 33.1, 33.14, 89/33.16, 33.5, 34

[56] References Cited

U.S. PATENT DOCUMENTS 2,375,437 5/1945 O'Hare ..... 89/33.14

2,386,894 10/1945 Hartley ..... 89/33.01

FOREIGN PATENT DOCUMENTS 755720 8/1956 United Kingdom ..... 89/33.14

*Primary Examiner*—Stephen C. Bentley

*Attorney, Agent, or Firm*—Antonelli, Terry & Wands

[57] ABSTRACT

For supplying a cartridge belt comprising individual, separable belt members from a magazine to a machine gun, a guide channel is provided which has an outwardly pivotable channel portion. The channel portion can be pivoted between a position aligned with the guide channel and a position aligned with a replacement ammunition channel, a pivoting device being provided which separate the two belt members located in the partial channel between the channel portion and the machine gun and connects same to a belt member in the replacement ammunition channel, so that without manual activity it is possible to fill an ammunition magazine and after pivoting back the channel portion the filled belt can be joined to the belt located above the separating point.

19 Claims, 11 Drawing Figures

FIG. 5
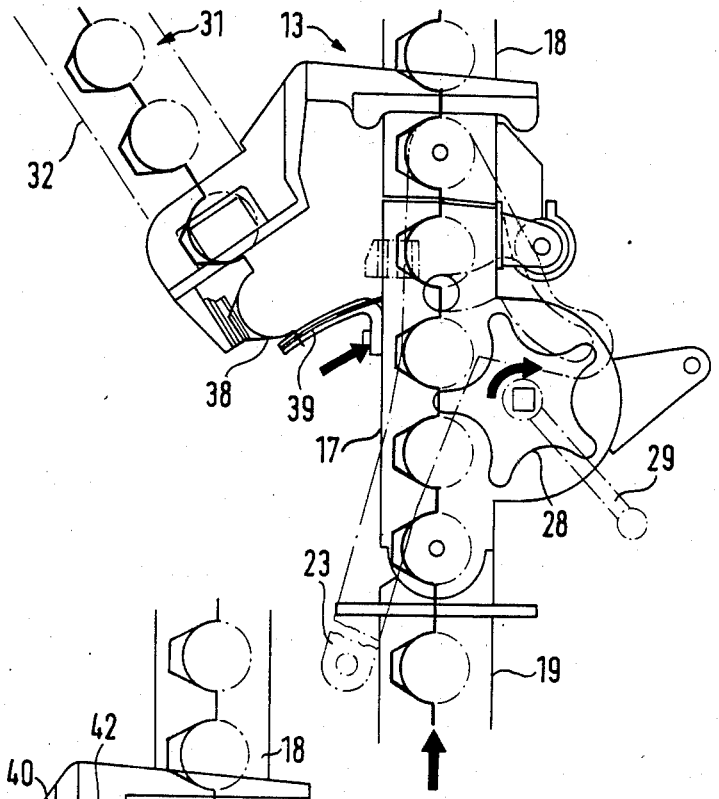
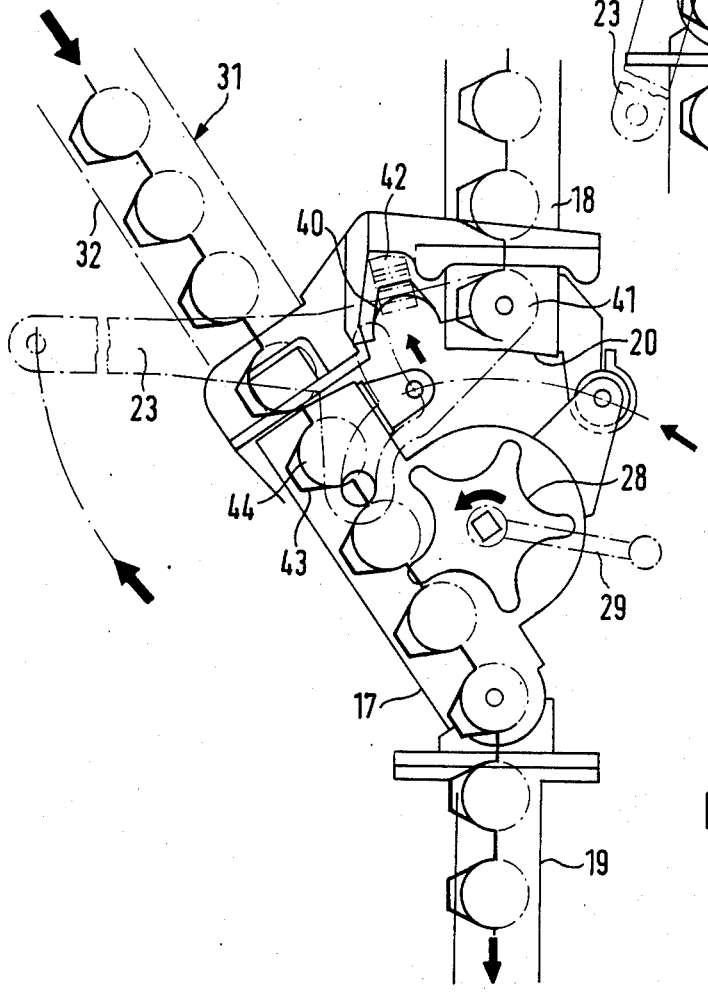
FIG. 6

APPARATUS FOR SUPPLYING CARTRIDGE BELTS FROM A MAGAZINE TO A MACHINE GUN

BACKGROUND OF THE INVENTION

The present invention relates to an apparatus with a guide channel for supplying cartridges arranged on a belt from a magazine to a machine gun by a drive acting on the belt or on the cartridge with, each belt member comprising a double claw guided with guide noses in the guide channel which axially and radially fixes the cartridge, as well as a single claw engaging in fixed manner between the double claw of the adjacent belt member in a flush, rotary manner, but fixed in the axial and belt direction, and with belt members being separable by an approximately radial movement.

Belts with disassemblable belt members are used in many machine guns in caliber range approximately 12.7 to 40 mm, different belt constructions being known. The invention relates to belts, in which each belt member comprises a double claw and an adjacent single claw, the double claw assentially assuming the retaining functions for the cartridge by resiliantly engaging round more than half the circumference of the cartridge by the two claws thereof and thereby radially fixes the same, as well as by of projections arranged thereon engages in a circumferential groove of the cartridge and consequently axially fixes the same. The single claw is fitted so that it can be pivoted to a limited extent to all sides on a web connecting the two claws of the double claw. It essentially assumes the connecting function for the belt and is rotatable on the cartridge. By its outwardly bevelled, lateral edges, the individual claw is mounted in a rotatable and axially fixed manner in grooves on the facing lateral edges of the two claws of the double claw, so that the belt is given its flexibility. The individual belt members are interconnected by axial insertion of the cartridge, in that the cartridge radially fixes the individual claw whilst maintaining the rotatability thereof. The double claw also guides the belt in the supply directions for the machine guns, in that on both claws are arranged outwardly projecting noses in spaced manner from the cartridge and which engage in corresponding guide grooves on the supply means In the case of machine guns, particularly when they are installed on vehicles, the cartridge belt is stored in an also carried magazine, e.g. in a ring magazine and is supplied by means of a mechanical drive from the magazine, via a guide channel to the gun. The magazine is generally equipped with a follow-up drive, which ensures that the belt can always run in a completely satisfactory manner into the guide channel.

The filling or refilling of the magazine, which is often positioned at difficultly accessible points, has exclusively been carried out by hand outside the guide channel, the separation of belt members or the joining of terminal belt members by the cartridge requiring considerable expenditure of force and considerable dexterity. In addition, such filling must take place at a point where there is sufficient space for these operations. Tha resulting time expenditure leads to undesired failures or losses when fighting.

SUMMARY OF THE INVENTION

The problem of the present invention is to provide a largely mechanically operating apparatus, which permits cartridge filling to take place without any significant manual activity. In a second step, the problem to be solved is that of permitting refilling with cartridges, while eliminating manual activity.

On the basis of the aforementioned apparatus, the first partial problem is solved in that for filling (a) the guide channel between the magazine and the mechanical belt drive has a separating point and beneath it a channel portion in the form of a switch point pivotable about a transverse spindle from the loading position and which can be aligned with a replacement ammunition channel, (b) in the vicinity of the channel portion is provided a hand drive acting on the belt or on the cartridges for supplying a replacement ammunition belt in the replacement ammunition channel through the swung out channel portion into the guide channel part leading to the magazine, (c) a pivoting device acting on the channel portion is provided which, after filling the magazine, separates the replacement ammunition belt at the separating point between the channel portion and the replacement ammunition channel and after pivoting back aligns the belt member located below the separating point in the channel portion with the guide channel part leading to the weapon, whereupon (d) the belt is conveyed by the hand drive into the guide channel part leading to the weapon to such an extent that it is engaged by the drive leading to the weapon or by the actual weapon.

The invention makes use of the principle of constructing a short portion of the guide channel in the manner of a switch or routing point, which is constantly connected to the guide channel leading to the magazine and can be aligned, as required, with the guide channel part leading to the weapon or with the replacement ammunition channel. The hand drive makes it possible to introduce the replacement ammunition belt into the magazine until it is automatically tightened up by the magazine drive. When the desired belt length has been stored in the magazine, then the channel portion is pivoted back and is brought into alignment with the guide channel leading to the gun. The pivoting device is constructed in such a way that it automatically separates the belt member which has last entered the channel portion from the replacement ammunition belt and moves the belt member into the loading position. There again, by the hand drive which acts on the belt members or cartridges located in the channel portion, the belt is drawn out of the magazine and introduced into the channel leading to the machine gun to such an extent that the leading belt end is taken over by the drive leading to the weapon or by the actual weapon. Thus, filling and belt change take place purely mechanically and consequently in a functionally reliable and reproducible manner. The only manual activity which is left is the working or reversing of the "switch point" and the operation of the manual drive for moving the belt over a relatively short distance. Thus, filling with cartridges can take place in a short time, so that the readiness to fight is rapidly restored.

The invention also makes it possible to solve the second part of the aforementioned problem in that for refilling the pivoting device separates the two belt members of the belt in the loading position located at the separating point between the channel portion and the guide channel, moves the belt member above same from the pivoting path of the channel portion, pivots the underlying belt member together with the cartridge located therein into the replacement ammunition channel and connects same to a corresponding empty belt member at the leading end of the replacement ammunition belt, then the replacement ammunition belt can be conveyed into the magazine until its belt member occupied by cartridges at the trailing end is located in the channel portion and finally, after pivoting back the channel portion into the loading position, the pivoting device moves back the belt member in the separating position to its initial position and thereby connects same to the belt member in the channel portion.

In the case of a gun ready for combat, there is still a continuous belt between the magazine and the machine gun. Refilling with cartridges is necessary if either only a short belt length or a belt length not adequate for a particular combat function is not present in the magazine. With the apparatus according to the invention, the belt leading from the magazine to the machine gun is separated at a random point, which is preferably easily accessible, the belt portion extending from the magazine into the pivotable channel portion is brought up to the replacement ammunition belt following the pivoting of the channel portion and during said pivoting movement is connected to the leading end of the replacement ammunition belt. In this position, the replacement ammunition belt can be introduced into the magazine, which optionally takes place automatically with the magazine follow-up drive. When the desired belt length has been stored in the magazine, the channel portion is pivoted back and the belt member which has last been introduced into the channel portion is separated from the replacement ammunition belt and in the loading position is connected to the belt member positioned directly above the separating point, so that the belt running to the machine gun is again closed. As a result of the special belt construction, it is necessary following the separation of a belt member in the vicinity of the separating point of the channel portion with respect to the guide channel leading to the machine gun, to move the last belt member therein out of the pivoting path of the channel portion and to move the first belt member in the channel portion, together with the cartridge therein into the cartridge filling position, where it is connected to the empty belt member posistioned at the leading end. Following filling and the subsequent pivoting back of the channel portion, accompanied by the simultaneous separation of the replacement ammunition belt, a belt member with the inserted cartridge again reaches the position directly below the separating point. The empty belt member locatad there is then pivoted back into the initial position and pressed on to the cartridge located there, so that the belt is closed and has no gaps. This makes rapid refilling possible during combat.

According to a preferred embodiment, the pivoting device moves the double claw of the belt member half positioned above the separating point and located directly below the latter out of the pivoting path of the channel portion, pivots the single claw corresponding thereto of the belt member below it, together with the cartridge therein and the channel portion up to the replacement ammunition channel, introduces same there into the empty double claw of the leading belt member of the replacement ammunition belt and after filling the channel portion pivots same back into the loading position together with the single claw which has just been introduced of the replacement ammunition belt and the inserted cartridge and moves back the double claw of the belt member positioned above the separating point into its initial position, so that same is placad on the single claw on the cartridge and consequently again closes the belt.

As a result of this construction, account is taken of the constructional features of the belt, the kinematics of the pivoting device being defined in such a way that the different movements can take place over the shortest possible paths.

According to an advantageous embodiment, the hand drive is formed from a starwheel provided with a starting crank with an arrangement of the star arms engaging between the cartridges corresponding to the belt spacing and the starwheel is mounted on tha channel portion and can be pivoted with same from the loading position into the filling position and back again.

The hand drive constructed in simple manner consequently follows the movement of the channel portion and can consequently fulfil its function both in the filling position and in the loading position. Both during filling with cartridges and during the subsequent feeding of the belt from the magazine into the channel leading to the gun, only a few revolutions on the hand crank are required, because then during the filling process for the belt tightening takes place through the magazine drive and during the loading process of the belt by means of the mechanical drive in the guide channel.

In accordance with the present invention, the starwheel includes a locking pawl and, in the locked position, serves as a detent for the belt in the channel portion. By virtue of these features, the hand drive starwheel is simultaneously used as a detent for the belt located in the channel portions so that during the complete separating and coupling process, the part of the belt always assumes a specific position within the channel portion permitting a completely satisfactory separation and connection of the belts.

In accordance with still further features of the present invention, an engageable and disengageable backstop for the belt located in part of the guide channel is provided immediately above the separating point between the channel portion and the guide channel part leading to the weapon. By virtue of these features, the last belt member located above the separating point can be positioned in a completely satisfactory manner.

Advantageously, according to the present invention, the belt stop is placed on the pivoting device and, on pivoting out of the channel portion, can be moved from a position below the belt path into a position engaging the guide channel and fixing the cartridge located directly above the separating point. With this arrangement, the backstop engages on the last where the cartridge immediately upstream of the separation point and, consequently, fixes the same.

It is also possible in accordance with the present invention to provide an arrangement whereby the channel portion immediately below the separating point has a separate wall portion with a part of the guide for the noses of a double claw and wherein the wall portion is arranged on the pivoting device and, during movement thereof, performs a pivoting movement about an axis of the cartridge located immediately above the separation point together with the double claw without a cartridge. Thus, apart from the belt member located in the vicinity of the separating point, a wall part of the channel portion is moved out of the pivoting path prior to its pivoting into the filling position so that the belt member still remains in the guide during this movement.

In accordance with still further features of the present invention, on the channel portion is mounted a driver located in the loading position outside the belt path which, at the start of pivoting movement of the channel portion, can be moved into a position fixing in the single claw the cartridge located immediately below the separating point and, while maintaining this position, is pivotable with the channel portion into the filling position and, after coupling, the single claw for the leading empty double claw of the replacement ammunition belt and pressing the cartridge into the same can be moved back into the position outside the belt path. By virtue of these features, the top cartridge in the channel portion immediately below the separating point is fixed by a driver and is consequently fixed and completely satisfactorily positioned so that it is possible to satisfactorily connect the part of the belt member moved during the pivoting of the channel portion as well as the cartridge with the leading empty belt member located in the replacement ammunition channel. In the filling and loading position, the driver can be moved into a position outside the belt path.

According to the present invention, the driver and the backstop for the belt in the loading position above the separating point are arrested or stopped in their position below the belt path. By this arrangement, a detent is provided for the driver and the backstop above the separating point to ensure that these parts do not pass in an ultimely manner into the belt path with the belt running.

The detent may, in accordance with the present invention, be formed by a stop arranged on the pivoting device and acting in the loading position. However, it is also possible to provide a spring element locked in the loading position between the stop and the driver which, when the stop is ineffective, moves the driver onto the cartridge located below the separating point and, after pivoting the channel portion into the filling position, can be forced back again by a stop located there.

In order to accurately position the leading empty belt member during the supply of the replacement ammunition belt or to hold back the latter in the loading position, in accordance with the present invention, on the channel portion is provided a skid extending in the loading position into the path of the replacement ammunition belt and simultaneously forms an entry stop and a positioning stop for the belt and only releases the latter toward the end of the pivoting movement of the channel portion.

In accordance with still further features of the present invention, the pivoting device is advantageously formed from a leather mounted on a pivot pin at right angles to the cartridge access immediately above the separating point of the guide channel and on which between the pivot pin and the transverse spindle of the channel portion is provided a link for a link pin arranged on the channel portion. The shape of the link leads to a corresponding kinematics both in the filling and loading position in the manner of a dead point position which prevents an untimely or unintentional modification of the position and which can only be overcome when a deliberate force is applied.

It is also possible in accordance with the present invention to construct the pivot lever in a pair-like manner, with one pivot lever being positioned in each case at opposite sides of the guide channel and both pivot levers being interconnected at a free end by a handle bar. As a result of the paired construction of the pivot lever, there is a symmetrical force transfer and introduction, with the handle bar connecting the two pivot levers offering a wide working surface for operating the pivoting device. The reversal or working of the channel portion functioning as a switch point can take place by a single handle, in that the handle bar is pivoted from one position to the other.

In order that the replacement ammunition channel, which is preferably constructed as a flexible channel, can be satisfactorily applied to the pivotable channel portion, on the guide channel above the positioning point is arranged a bracket extending into the filling position and set up for applying the replacement ammunition channel.

Advantageously, on the bracket is arranged the stop moving the driver on the channel portion away from the cartridge from the filling position whereby the bracket can simultaneously have a stop which forces the driver away from the cartridge for fixing the top cartridge in the channel portion in the filling position.

It is further possible in accordance with the present invention to provide a structural unit which can be incorporated in the guide channel by means of terminal flanges, which structural unit can also subsequently be use on existing guide channels by cutting or separating out a corresponding portion. More particularly, the pivotable channel portion, the pivoting device and all parts arranged thereon, as well as a part corresponding to approximately half of the belt length of the guide channel located above the separating point are combined to form the structural unit which by virtue of the terminal flanges can be inserted in the guide channel between the magazine and the machine gun.

BRIEF DESCRIPTION OF THE DRAWINGS

The invention is described in greater detail hereinafter relative to non-limitative embodiments and the attached drawings, wherein show;

FIGS. 2 to 8—Different positions of an embodiment of the apparatus in side view.

DETAILED DESCRIPTION OF THE PREFERRED EMBODIMENTS

Figure 1:
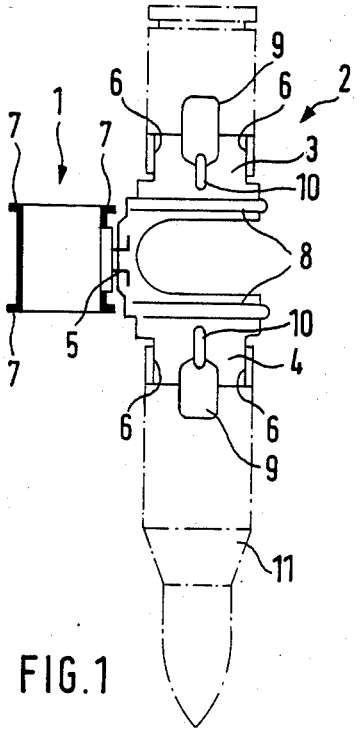
FIG. 1—A view of a single belt member.

The belt member shown in FIG. 1 comprises a single claw 1 and a double claw 2 with two spaced claws 3, 4, which are all formed from sheet metal extruded parts. The single claw 1 is connected to double claw 2 by a connection 5 having a limited mobility in all directions. Single claw 1 and double claw 2 are constructed in shell-like manner, the edges 6 of the two claws 3, 4 of double claw 2 being drawn inwards, so that they surround more than a half arc.

The lateral edges 7 of the single claw 1 are outwardly bevelled, whilst in the vicinity of the facing lateral edges of the two claws 3, 4 forming double claw 2 there are two grooves B. The double claw 2 also has approximately axially extending guide noses 9, which are pressed outwards out of the shell contour plane, i.e. are located on a larger diameter than the shells formed by claws 3, 4. The double claw 2 also has inwardly projecting projections 10 which, like the noses 9, are located in the vicinity of the apex of claws 3, 4.

As a result, the belt members of FIG. 1 are combined to form a cartridge or ammunition belt by the single claw 1 (from the top in FIG. 1) being inserted with its bevelled lateral edges 7 into the grooves 8 of the double claw 2. The grooves 8 on the one hand form a pivot bearing and on the other an axial fixing system for the single claw 1. The shell surface of the single claw 1 is flush with respect to the shell faces of claws 3, 4 of double claw 2. A cartridge 11 is then axially inserted and radially fixes the single claw 1 located in the double claw 2, so that the adjacent belt members are interconnected. Cartridge 11 is radially secured by claws 3, 4, which engage round more than half its circumference, whilst it is positioned in the axial direction in that one of the projections 10 engages in a corresponding circumferential groove on the cartridge case. It is optionally possible to provide only a single projection 10 to orient the cartridge 11 in a specific direction with respect to the belt.

Figure 9:
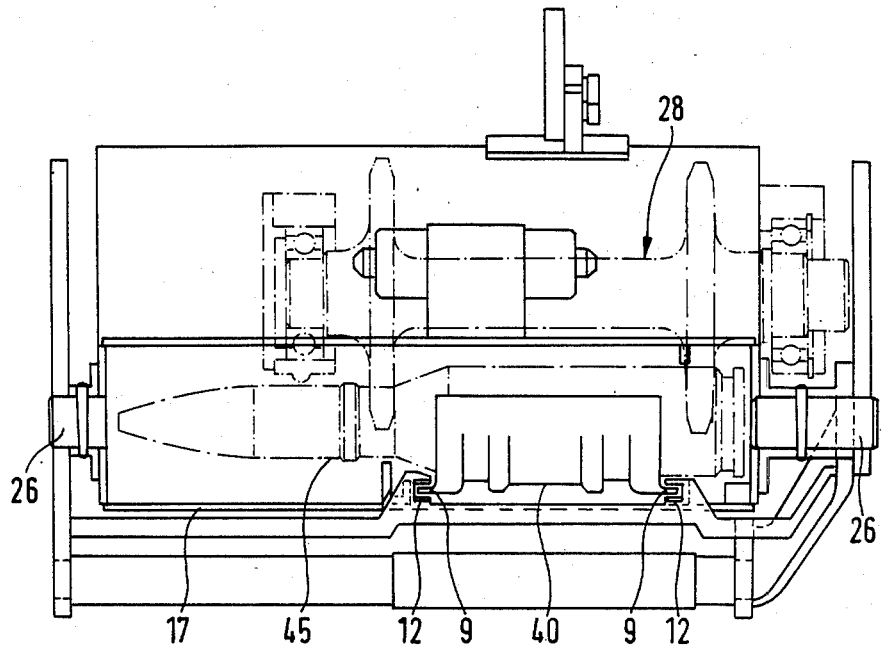
FIG. 9—A section IX—IX according to FIG. 7.

A belt completed in this way can be guided by means of the radially projecting guide noses 9 into corresponding guide grooves 12 of a supply channel (cf. FIG. 9).

Figure 2:
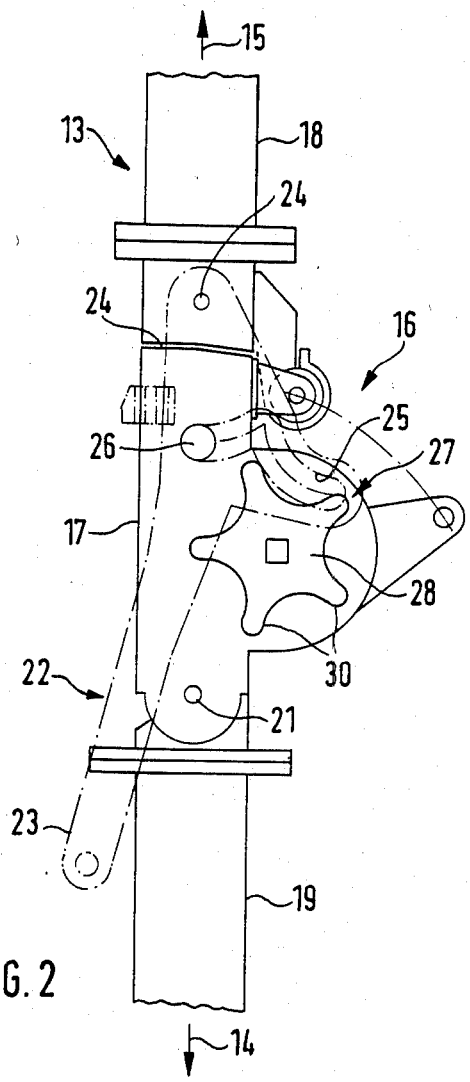

FIG. 2 shows a guide channel 13, which is arranged between a not shown magazine located in the direction of arrow 14 and an also not shown machine gun located in the direction of arrow 15. The apparatus 16 according to the invention is arranged on said guide channel and initially has a channel portion 17, which is positioned between the part 18 leading to the machine gun and the part 19 coming from the magazine. Between part 18 and channel portion 17 is provided a roughly arcuate separating point 20. Channel portion 17 is pivotably mounted on a transverse spindle 21. There is also a pivoting device 22 with a manually operable pivot lever 23, which is once again mounted on a transverse spindle 24 on part 18 of guide channel 13. Between the two transverse spindles 21, 24, pivot lever 23 has a link 25 for a linkpin 26 located on channel portion 17.

Figure 3:
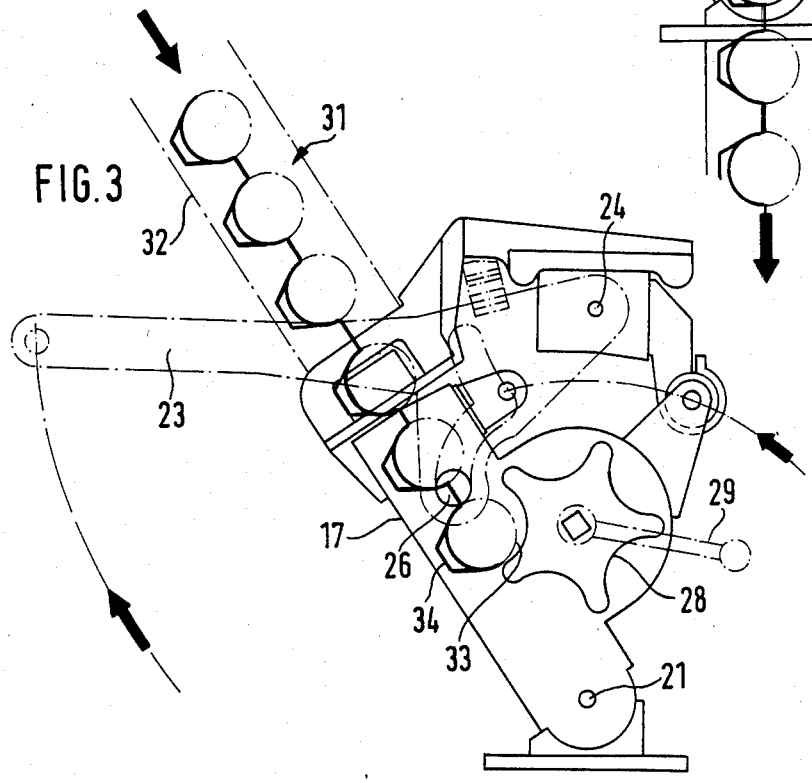

On channel portion 17 is provided a hand drive 27, which is formed from a starwheel 28 positioned transversely with respect to guide channel 13 and which is laterally displaced with respect thereto, as well as a hand crank 29 (cf. FIG. 3). Starwheel 28 has star arms 30, whose arrangement and spacing corresponds to the belt spacing and which engage between the cartridges located in channel portion 17. By turning crank 29, the belt portion located in the channel portion 17 can be conveyed upwards or downwards. A not shown mechanical drive is provided for the belt running in part 18 of guide channel 13.

FIG. 2 shows the basic positions without ammunition, in which part 19 of guide channel 13, channel portion 17 and part 18 of guide channel 13 are aligned. If the magazine is to be filled, then the channel portion 17 is pivoted out of the position according to FIG. 2 by means of the pivot lever 23 into the position according to FIG. 3, the linkpin 26 moving from one end of link 25 to the other. In the position according to FIG. 3, channel portion 17 is aligned with the replacement ammunition belt 31, which is fed in a preferably flexible replacement ammunition channel 32 to such an extent that the first cartridge 33 or the leading end 34 of the replacement ammunition belt 31 has penetrated channel portion 17 far enough for it to engage on starwheel 2B. By rotating the hand crank 29 in the direction of arrow 35 (FIG. 4), the replacement ammunition belt is conveyed through the channel portion 17 into the guide channel part 19 leading to the magazine. After a few revolutions of hand crank 29, the belt has been introduced so far into the magazine that it is further tightened by said movement. When cartridge filling has been completed, the pivoting device 22 with channel portion 17 is pivoted back into the position shown in FIG. 5 by means of lever 23. The belt member located at the separating point between channel portion 17 and the replacement ammunition channel 32 is separated by driving the single claw located immediately below the separating point, together with the cartridge. In FIG. 5 the loading position is reached, in which by means of a few revolutions of hand crank 29, belt 37 is conveyed out of the magazine and through channel portion 17 into part 18 of guide channel 13 leading to the machine gun until it is engaged there by the mechanical belt drive.

As can be seen in FIG. 5, a skid 39 is laterally positioned on the channel portion 17 and extends into the path of the replacement ammunition belt 31 and during the separation of said belt supports the double claw 38 remaining there, which now forms the leading end of replacement ammunition belt 31, so that replacement ammunition belt 31 is held back and remains perfectly positioned.

Figure 4:
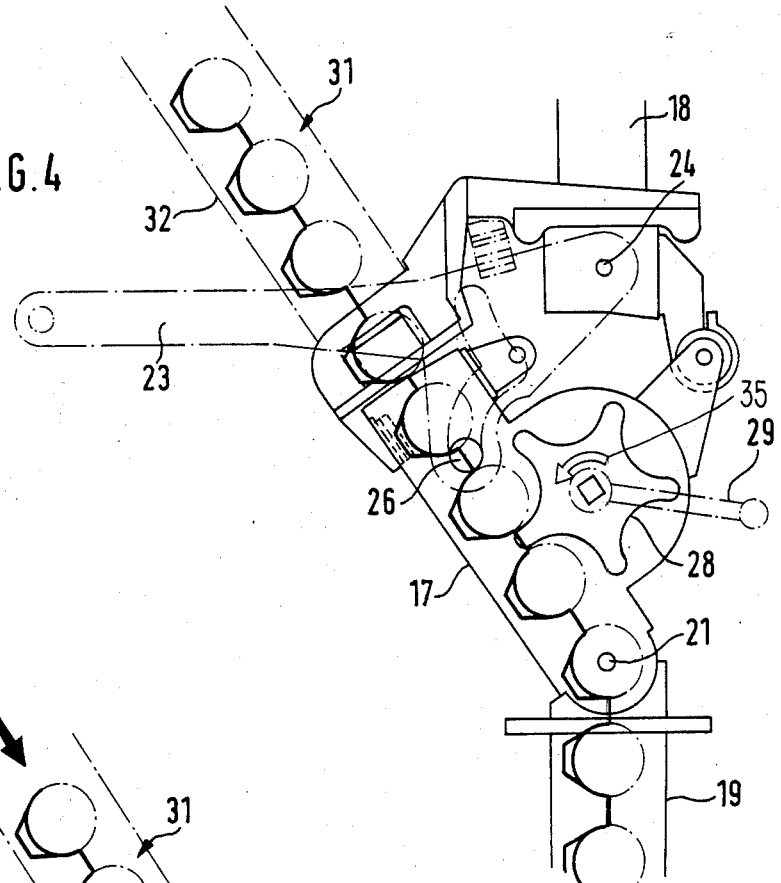
Figure 7:
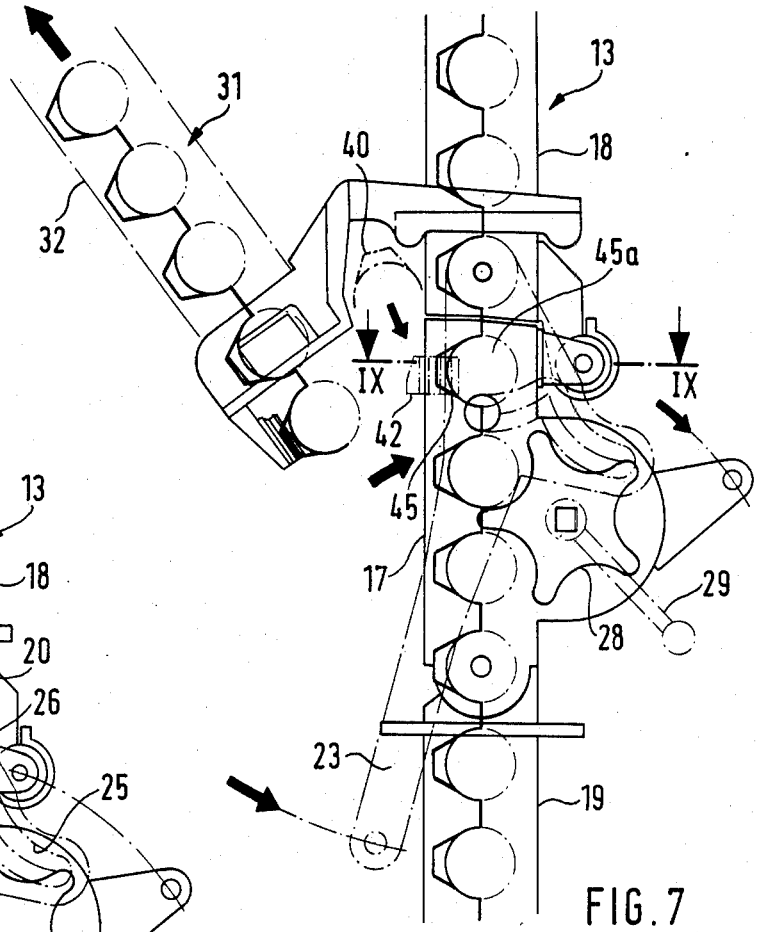
Figure 8:
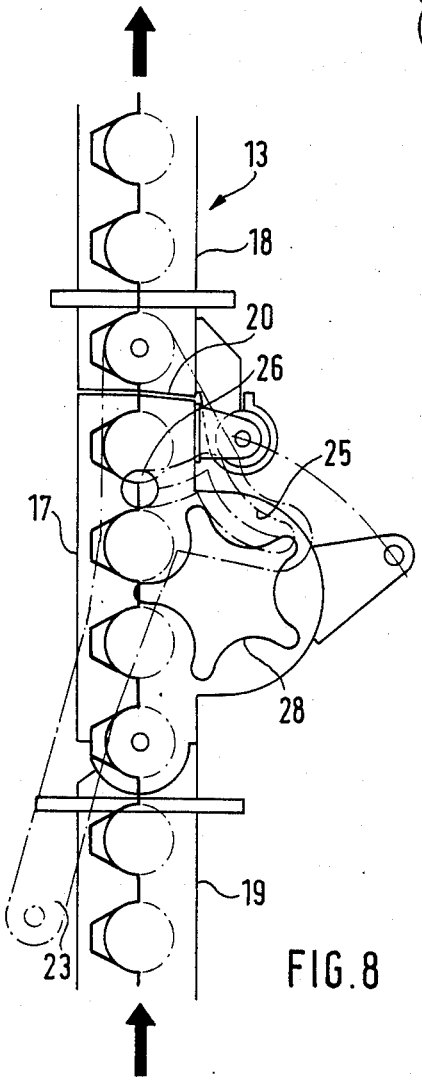

Whilst FIGS. 3 to 5 show certain positions when filling with cartridges, FIGS. 6 to 8 show refilling. From the loading position according to FIG. 5 in which the belt 37 runs from the magazine to the machine gun, the channel portion 17 is pivoted by pivoting device 22 and the pivot lever 23 associated therewith into the filling position according to FIG. 6. The two belt members bridging the separating point 20 between the channel portion 17 and part 18 of guide channel 13 are separated and the belt member remaining in part 18 or its empty double claw 40 is moved out of the pivot path of channel portion 17. In the represented embodiment, the belt member rotates round the last cartridge 41 in part 18 of guide channel 13. For this purpose, the channel portion 17 has a separate wall portion 42, which is provided with a guide for the noses on double claw 40 and is arranged on the pivoting device 22. During this pivoting movement, the single claw 43 positioned below the separating point 20, together with inserted cartridge 44 is moved into the filling position, single claw 43 penetrating the double claw 38(FIG. 5) of the replacement ammunition belt and cartridge 44 is pressed into the double claw. Thus, the belt located in channel portion 17 is connected to the leading end of the replacement ammunition belt 31, so that once again the replacement ammunition belt can ba conveyed into the magazine with the hand crank 29 and starwheel 28. When the magazine has been adequately filled, the channel portion is pivoted back again. Once again a single claw positioned in the channel portion below the separating point, together with an inserted cartridge moves back into the loading position according to FIG. 7.

Shortly before reaching the loading position, pivoting device 22 pivots back the empty double claw 40 with the wall portion 42 guiding it into the initial position, the double claw engaging with its grooves over the lateral edges of the single claw 45 located below the separating point 20 and presses same on to cartridge 45*a* located there. In this position, the belt end located in part 18 of guide channel 13 is connected to the leading belt end in channel portion 17, so that shooting is possible in the position according to FIG. 8.

Figure 10:
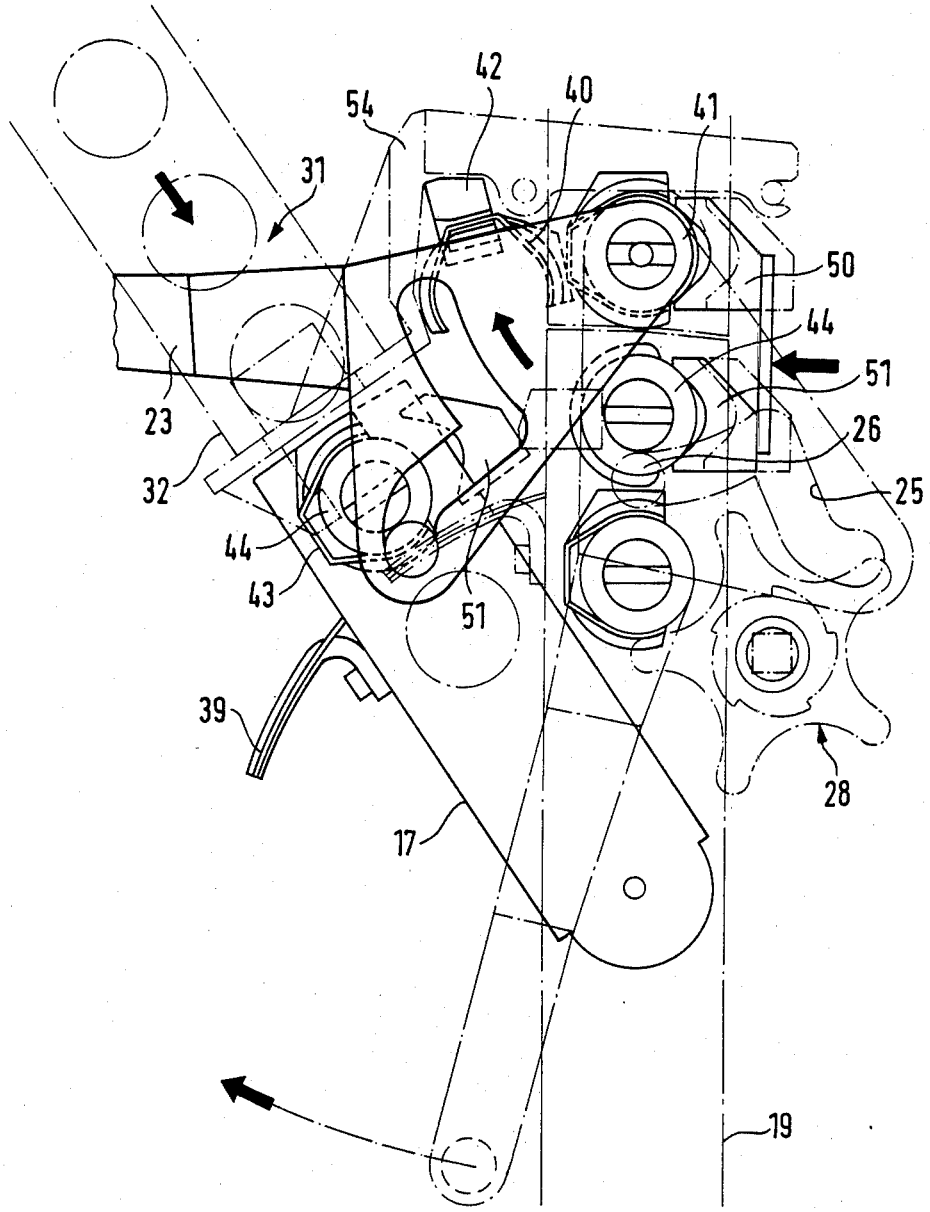
FIG. 10—A larger-scale detail of the apparatus in the position according to FIG. 6.
Figure 11:
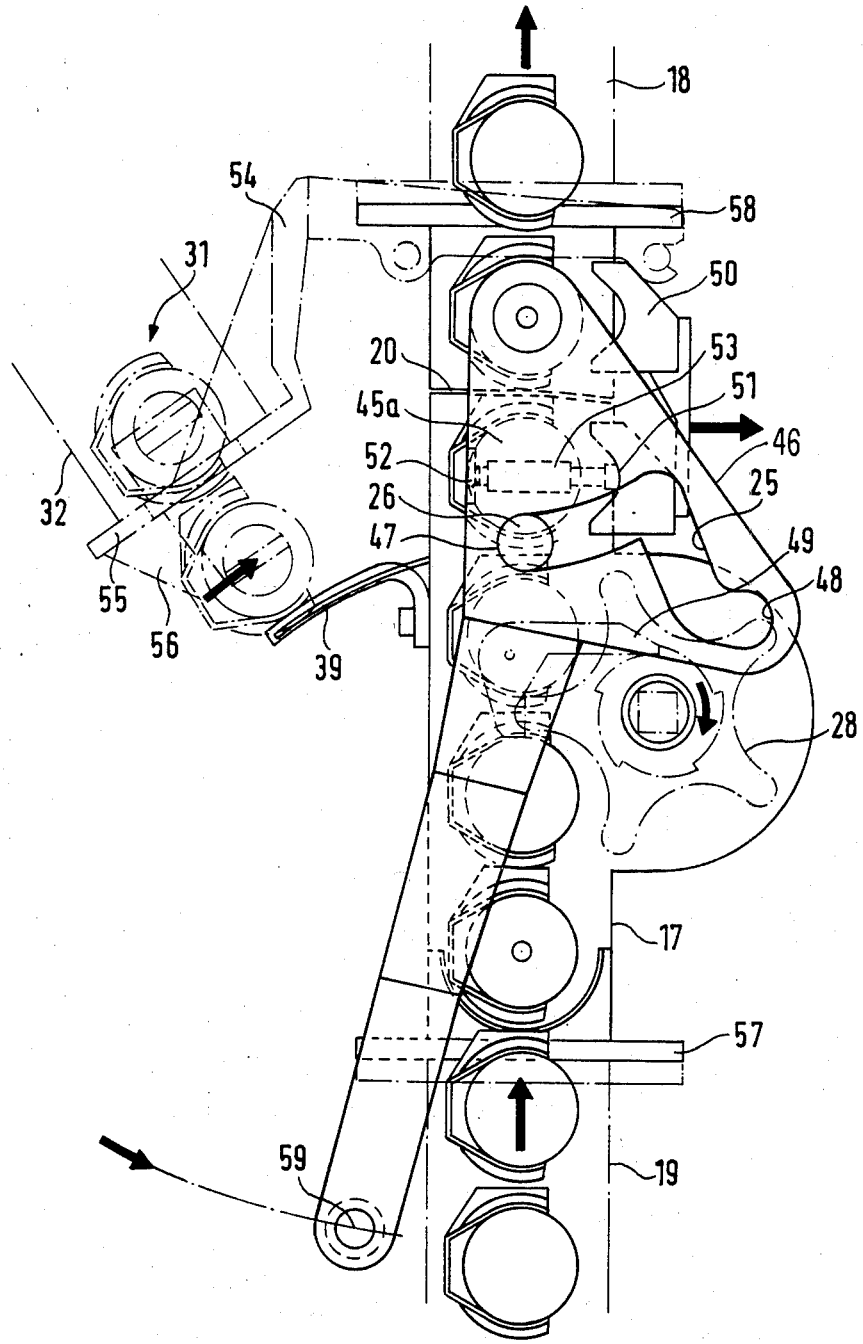
FIG. 11—A view corresponding to FIG. 10 of the apparatus in the position according to FIG. 7.

The individual parts of the pivoting device 22 are shown in greater detail in FIGS. 10 and 11. FIG. 10 shows a position corresponding to FIG. 6 and FIG. 11 a position corresponding to FIG. 7. As can in particular be seen from FIG. 11, the pivot lever 23 has a triangular widened portion 46 in which is arranged link 25. The latter is constricted in knee-shaped manner, so that a type of dead point position for the linkpin 26 is formed on its ends 47, 48. Starwheel 28 is provided with a back stop 49, which in the blocked state forms a locking pawl for the belt portion located in ohannel portion 17. By lifting out the locking pawl 49, starwhael 28 can be used for conveying the replacement ammunition belt into the magazine during filling or refilling with cartridges. Pivoting device 22 carries a further back stop 50 for the belt located in part 18 of guide channel 13. The pivoting device also carries a driver 51 immediately below the separating point 20. This driver, like the back stop 50 in the loading position is arrested in a position outside the belt path by means of a stop 52 positioned on the pivot lever 23. Between stop 52 and driver 51 is arranged a spring element 53, which is rendered ineffective in the loading position according to FIG. 11 by stop 52. On swinging up the pivot lever 23, in which the link pin 26 moves out of the end 47 of link 25, over the knee into end 48 and reaches same when the channel portion 17 is in the filling position, stop 52 is freed from spring element 53, so that link 25 engages on the last cartridge 41 in part 18 of guide channel 13 and fixes same, while the driver 52 engages on cartridge 44 and secures the latter together with the single claw in channel portion 17. Thus, neither the belt portion in part 18 of guide channel 13, nor the belt portion in channel portion 17, can run back. After separating the two belt members pressing on the seperating point 20, double claw 40 with wall portion 42 is pivoted upwards round cartridge 41 (cf. FIG. 10) and the cartridge 44 fixed by driver 51 in channel portion 17 is inserted or pressed with tha single claw into the empty double claw 43 in the filling position. Towards the end of the movement and as intimated in FIG. 10, driver 51 is again raised from cartridge 44 counter to the action of spring element 53, so that the belt can pass through channel portion 17.

On part 18 of drive channel 13 is provided a bracket 54, which is provided at its free end with a shoulder 55 for the replacement ammunition channel 31 and a stop 56, against which runs the spring element 53. The shoulder 55 has a guide for the empty double claw in the filling position supplementing the pivoted out wall portion 42 with the guide for a double claw.

The complete apparatus comprising channel portion 17, pivoting davice 16 and bracket 54 is combined to form a structural unit with terminal flanges 57, 58, which can at any time be subsequently inserted in existing guide channels after removing a corresponding portion.

The pivot lever 23 is constructed in paired manner, each lever being arranged on each side of the guide channel 13, both levers being connected by a handle bar 59.

What is claimed is:

1. An apparatus with a guide channel for supplying cartridges arranged on a belt from a magazine to a machine gun by means of a drive acting on the belt or on the cartridges, each belt member comprising a double claw guided with guide noses in the guide channel which axially and radially fixes the cartridge, as well as a single claw engaging in fixed manner between the double claw of the adjacent belt member in a flush, rotary manner, but fixed in the axial and belt direction, adjacent belt members being separable by an approximately radial movement, wherein for filling (a) the guide channel between the magazine and the mechanical belt drive has a separating point and beneath it a channel portion in the form of a switch point pivotable about a transverse spindle from the loading position and which can be aligned with a replacement ammunition channel, (b) in the vicinity of the channel portion is provided a hand drive acting on the belt or on the cartridges for supplying a replacement ammunition belt in the replacement ammunition channel through the swung out channel portion into the guide channel part leading to the magazine, (c) a pivoting device acting on the channel portion is provided which, after filling the magazine, separates the replacement ammunition belt at the separating point between the channel portion and the replacement ammunition channel and after pivoting back aligns the belt member located below the separating point in the channel portion with the guide channel part leading to the weapon, whereupon (d) the belt is conveyed by means of the hand drive into the guide channel part leading to the weapon to such an extent that it is engaged by the drive leading to the weapon or by the actual weapon.

2. An apparatus, particularly according to claim 1, wherein for refilling the pivoting device separates the two belt members of the belt in the loading position located at the separating point between the channel portion and the guide channel, moves the belt member ahove same from the pivoting path of the channel portion, pivots the underlying belt member together with the cartridge located therein into tha replacement ammunition channel and connects same to a corresponding empty belt member at the leading end of the replacement ammunition belt, then the replacement ammunition belt can be conveyed into tha magazine until its belt member occupied by cartridges at the trailing end is located in the channel portion and finally, after pivoting back the channel portion into the loading position, the pivoting device moves back the belt member in the separating position to its initial position and thereby connects same to the belt member in the channel portion.

3. An apparatus according to claims 1 or 2, wherein pivoting device moves the double claw of the belt member half positioned above tha separating point and located directly below the latter out of the pivoting path of the channel portion, pivots the single claw corresponding thereto of the belt member below it, together with the cartridge therein and the channel portion up to the replacement ammunition channel, introduces same there into the empty double claw of the leading belt member of the replacement ammunitio belt and after filling the channel portion pivots same back into the loading position together with the single claw which has just been introduced of the replacement ammunition belt and the inserted cartridge and moves back the double claw of the belt member positioned above the separating point into its initial position, so that same is placed on the single claw on the cartridge and consequently again closes the belt.

4. An apparatus according to claim 1, wherein the hand drive is formed from a starwheel provided with a starting crank with an arrangement of star arms engaging between the cartridges corresponding to the belt spacing and wherein the starwheel is mounted on the channel portion and can be pivoted therewith from the loading into the filling position and back again.

5. An apparatus according to claim 4, wherein the starwheel has a locking pawl and in the locked position serves as a detent for the belt in the channel portion.

6. An apparatus according to claim 1, wherein an engageable and disengageable back stop for the belt located in this part of the guide channel is provided immediately above the separating point between the channel portion and the guide channel part leading to the weapon.

7. An apparatus according to claim 6, wherein the back stop is placed on the pivoting device and on pivoting out the channel portion can be moved from a position below the belt path into a position engaging in the guide channel and fixing the cartridge located directly above the separating point.

8. An apparatus according to claim 1, wherein the channaI portion immediately below the separating point has a separate wall portion with a part of the guide for the noses of a double claw and wherein said wall portion is arranged on the pivoting device and during the movement thereof performs a pivoting movement about the axis of the cartridge located immediately above the separating point together with the double claw without cartridge.

9. An apparatus according to claim 8, wherein on the channel portion is mounted a driver located in the loading position outside the belt path and which at the start of the pivoting movement of the channel portion can be moved into a position fixing in the single claw the cartridge located immediately below the separating point and whilst maintaining this position is pivotable with the channel portion into the filling position and after coupling the single claw to the leading empty double claw of the replacement ammunition belt and pressing the cartridge into the same can be moved back into a position outside the belt path.

10. An apparatus according to one of the claims 4 or 9, wherein the driver and the back stop for the belt in the loading position above the separating point are arrested in their position below the belt path.

11. An apparatus according to claim 9, wherein the detent is formed by a stop arranged on the pivoting device and acting in the loading position.

12. An apparatus according to claim 10, wherein a spring element locked in the loading position is arranged between the stop and the driver which, when the stop is ineffective, moves the driver on to the cartridge located below the separating point and after pivoting the channel portion into the filling position can be forced back again by a stop located there.

13. An apparatus according to claim 1, wherein on the channel portion is provided a skid extending in the loading position into the path of the replacement ammunition belt and which simultaneously forms an entry stop and a positioning stop for said belt and which only releases the latter towards the end of the pivoting movement of the channel portion.

14. An apparatus according to claim 1, wherein the pivoting device is formed from a lever mounted on a pivot pin at right angles to the cartridge axis immediately above the separating point of the guide channel and on which between said pivot pin and the transverse spindle of the channel portion is provided a link for a linkpin arranged on the channel portion.

15. An apparatus according to claim 14, wherein the link runs substantially at right angles to the lever extension and is constructed in knee-like manner with in each case one dead point position for the linkpin at the ends of the link.

16. An apparatus according to claim 14, wherein the pivot lever is constructed in pair-like manner, one pivot lever being positioned in each case at opposite sides of the guide channel and both pivot levers being interconnected at their free end by means of a handle bar.

17. An apparatus according to claim 1, wherein on the guide channel above the positioning point is arranged a bracket extending into the filling position and which is set up for applying the replacement ammunition channel.

18. An apparatus according to claim 17, wherein on the bracket is arranged the stop moving the driver on the channel portion away from the cartridge in the filling position.

19. An apparatus according to claim 1, wherein the pivotable channel portion, the pivoting device and all parts arranged thereon, as well as a part corresponding to roughly half the belt length of the guide channel located above the separating point are combined to form a structural unit which, by means of terminal flanges, can be inserted in the guide channel between the magazine and the machine gun.

* * * * *